US009592613B2

(12) United States Patent
Pohl et al.

(10) Patent No.: US 9,592,613 B2
(45) Date of Patent: Mar. 14, 2017

(54) SHAVING HEAD WITH MULTIPLE SHAVING UNITS

(75) Inventors: Thorsten Pohl, Muehlheim (DE); Joachim Krauss, Pfungstadt (DE); Tobias Schwarz, Schmitten (DE); Peter Junk, Schmitten (DE); Reinhold Eichhorn, Idstein (DE); Andreas Peter, Kronberg (DE); Michael Odemer, Niddatal (DE); Martin Fuellgrabe, Bad Camberg (DE); Christoph Zegula, Roedermark (DE); Alois Koeppl, Weilrod (DE); Stefan Fuerst, Kronberg (DE)

(73) Assignee: Braun GmbH, Kronberg (DE)

( * ) Notice: Subject to any disclaimer, the term of this patent is extended or adjusted under 35 U.S.C. 154(b) by 1242 days.

(21) Appl. No.: 13/193,648

(22) Filed: Jul. 29, 2011

(65) Prior Publication Data

US 2012/0055025 A1 Mar. 8, 2012

(30) Foreign Application Priority Data

Sep. 3, 2010 (EP) ..... 10009208

(51) Int. Cl.
*B26B 19/12* (2006.01)
*B26B 19/02* (2006.01)
(Continued)

(52) U.S. Cl.
CPC ..... *B26B 19/04* (2013.01); *B26B 19/06* (2013.01); *B26B 19/10* (2013.01)

(58) Field of Classification Search
CPC ..... B26B 19/04; B26B 19/10; B26B 19/06
(Continued)

(56) References Cited

U.S. PATENT DOCUMENTS 2,240,264 A 4/1941 Muros
2,279,102 A * 4/1942 Altemus ..... 30/43.92
(Continued)

FOREIGN PATENT DOCUMENTS

DE 1111062 B 7/1961
DE 2841692 A1 4/1980
EP 1930135 A1 6/2008

OTHER PUBLICATIONS

U.S. Appl. No. 13/193,644, filed Jul. 29, 2011, Thorsten Pohl et al.
(Continued)

*Primary Examiner* — Ghassem Alie
*Assistant Examiner* — Bharat C Patel
(74) *Attorney, Agent, or Firm* — Ronald T. Sia; Kevin C. Johnson; Steven W. Miller

(57) ABSTRACT

A shaving head for an electric dry shaver includes a base element for carrying at least three cutter units. Each unit provides an outer cutter and an inner cutter arranged to be moved in sliding contact relative to each other. At least one cutter unit includes a foil-type outer cutter. The shaving head further includes a first trimmer-type cutting unit that has a plurality of slots defined by a plurality of adjacent bar elements featuring cutting edges. The shaving head also includes a second trimmer-type cutting unit having an outer cutter that includes a plurality of teeth featuring cutting edges and spaced apart from each other so as to define a plurality of slits.

10 Claims, 5 Drawing Sheets

(51) Int. Cl.

| | |
|---|---|
| ***B26B 19/28*** | (2006.01) |
| ***B26B 19/04*** | (2006.01) |
| ***B26B 19/06*** | (2006.01) |
| ***B26B 19/10*** | (2006.01) |

(58) Field of Classification Search
USPC ..... 30/43.92, 43.9, 34.1, 43.7, 43.8, 43.91
See application file for complete search history.

(56) References Cited

U.S. PATENT DOCUMENTS

| | | | | |
|---|---|---|---|---|
| 2,298,962 | A * | 10/1942 | Murphy | 30/43.92 |
| 2,325,267 | A * | 7/1943 | Murphy | 30/43.92 |
| 2,331,274 | A * | 10/1943 | Martin | 30/43.92 |
| 2,706,332 | A * | 4/1955 | Murphy | 30/41.6 |
| 2,859,513 | A * | 11/1958 | Bylund | 30/43.92 |
| 2,915,816 | A * | 12/1959 | Gray | 30/43.92 |
| 4,081,902 | A * | 4/1978 | Locke | 30/43.92 |
| 4,274,199 | A | 6/1981 | Gallanis et al. | |
| 4,393,586 | A | 7/1983 | Hamashima et al. | |
| 5,669,138 | A * | 9/1997 | Wetzel | 30/43.92 |
| 5,946,806 | A * | 9/1999 | Watanabe et al. | 30/43.92 |
| 6,073,348 | A * | 6/2000 | Shiba | 30/34.1 |
| 6,082,005 | A * | 7/2000 | Tezuka | 30/43.92 |
| 6,293,017 | B1 * | 9/2001 | Sato et al. | 30/43.92 |
| 7,237,339 | B2 * | 7/2007 | Parsonage et al. | 30/43.92 |
| 7,464,471 | B2 * | 12/2008 | Fukutani et al. | 30/43.91 |
| 7,730,621 | B2 * | 6/2010 | Komori et al. | 30/346.51 |
| 7,739,798 | B2 * | 6/2010 | Iwasaki et al. | 30/43.92 |
| 2001/0039734 | A1 * | 11/2001 | Kadijk et al. | 30/43.6 |
| 2004/0055158 | A1 * | 3/2004 | Izumi et al. | 30/43.92 |
| 2005/0016002 | A1 * | 1/2005 | Fukutani et al. | 30/527 |
| 2008/0040935 | A1 * | 2/2008 | Gratz | 30/539 |
| 2010/0175258 | A1 | 7/2010 | Kleine Doepke et al. | |

OTHER PUBLICATIONS

International Search Report dated Jan. 31, 2011, 3 pgs.
International Search Report dated Jan. 28, 2011, 3 pgs.

* cited by examiner

SHAVING HEAD WITH MULTIPLE SHAVING UNITS

FIELD OF THE INVENTION

This invention relates to a shaving head for an electric dry shaver according to the generic part of claim 1. It is especially directed to dry shavers having a shaving head with multiple cutting units.

BACKGROUND OF THE INVENTION

Shaving heads of the type initially referred to are known for example from EP 0693988 B1. This document discloses an electric dry shaver where a center trimmer is arranged between two foil type shaving elements. The upper cutter of this center trimmer is provided with hair feeding means consisting of projecting teeth which are directed outwardly. Those center trimmers in general are rather effective in cutting the hairs to a very short remaining length of hair. With respect to hairs which are resting flat against the skin the performance of the known cutting system is not optimal since such hairs—especially if they are located on skin areas with flexible skin—tend to escape from the feeding area formed between two teeth of the comb-shaped feeding means.

From the EP 1930135 A1 there is known a shaving head with three foil-type cutters and a center trimmer which comprises a multiplicity of bars arranged at a small distance to each other, so as to form small slits between the bars. Such kinds of center trimmers are a more open construction without a center bar arranged along the longitudinal axis of the trimmer. Cutting units of this type have proven to be mechanically stable even with a small thickness of the outer cutter. The drawback of this kind of shaving units is the risk to cause skin irritations. The center trimmer according to the EP 1930135 A1 acts to the hairs like an expanded comb when moved during a shaving stroke along the skin. The hairs will then be directed accordingly. However, hairs to be cut have to pass completely through the height of the outer cutter of the center trimmer which most likely will not happen to hairs lying flat to the skin.

SUMMARY OF THE INVENTION

It is therefore an objective of the present invention to overcome all the drawbacks of the known shaving systems as specially such as discussed above and to provide an improved shaving head for electric shavers of the type initially referred to such to ensure an optimal shaving quality, especially when shaving hairs lying flat to the skin in both skin regions with high flexibility as well as skin regions with minor flexibility, whereby the shaving will provide an extremely high closeness as well as it avoids skin irritations.

This objective is accomplished by the combination of features as indicated in claim 1.

The shaving head according to the invention comprises two different kinds of trimmer-type cutters, a first trimmer-type cutting unit having an outer cutter that comprises a plurality of slots defined by a plurality of adjacent bar elements featuring cutting edges, and a second trimmer-type cutting unit having an outer cutter that comprises a plurality of teeth featuring cutting edges and spaced from each other to define a plurality of slits. Together with the at least one foil-type cutting unit they deliver a shaving performance with an additional synergistic effect when performing as a system of coordinated components and fine tuned cutting units. This results in an outstanding closeness of the shave because the shaving head according to the invention during one shaving stroke stretches the skin, lifts tricky and flat lying hairs regardless whether they grow on highly flexible skin areas or on less flexible skin areas and captures hairs growing in different directions while being gentle to the skin and avoiding skin irritations.

In a preferred embodiment of the invention there is provided a further cutting unit of the foil type and that the two trimmer-type cutting units are arranged between the two foil-type cutting units. This ensures an optimal contact and adaptation of the shaving head to the skin independent of the skin contour. It further helps to provide optimal stretch to the skin and additionally makes the shaving result independent of the direction of the stroke. More over it helps to control the skin wave produced in front of the shaving head and between the different cutting units during a shaving stroke. The adaptability is even improved when the cutting units are mounted on the base element in a floatable manner in the vertical direction. However, also other combinations or arrangements of the four cutting units on the base element are within the scope of the invention.

In an embodiment where the cutting units are interconnected with vertical play via coupling elements it is ensured that difference of exposure of single cutting units—especially of the trimmer-type cutting units—is limited, which has a positive effect to the avoidance of skin irritations since the trimmer-type cutting units are thereby always slightly covered by the foil-type cutting units which is consequently protecting the skin. The limitation of the exposure prevents too excessive skin deformations in front of the center-trimmers, which has a positive effect to the avoidance of skin irritations. The skin protection can even be improved if a skin protecting guard element is arranged between the first trimmer-type cutting unit and the adjacent foil-type cutting unit. In a preferred embodiment the guard element is fixed to the first trimmer-type cutting unit.

A particularly effective lifting of flat lying hairs during a shaving stroke is achieved if the outer cutter of the foil-type cutting unit is shaped essentially semi-cylindrically along its longitudinal axis and that at least one of the trimmer-type cutting units comprises a top surface which is not plane. This geometry of surfaces applies a deformation to the skin during shaving which exposes a force or a moment to the hair which can help raising hairs lying flat to the skin. That effect can be enhanced if the first trimmer-type cutting unit provides a concave top surface and the second trimmer-type cutting unit has a convex or a roof-shaped surface. However, especially the second trimmer-type cutting unit might also be providing a flat surface to contact the skin.

To reach a maximum of feeding performance a further version of the invention provides that the outer cutter of the second trimmer-type cutting unit comprises two comb elements disposed opposite one another, whereby the teeth of the first comb element are facing the teeth of the second comb element. Especially the teeth of the comb elements extend along the lateral axis and are angled with respect to the horizontal plane such that their tips are elevated.

BRIEF DESCRIPTION OF THE DRAWINGS

The invention will be further elucidated by detailed explanation of exemplary embodiments and by reference to figures. In the figures

DETAILED DESCRIPTION OF THE INVENTION

Figure 1:
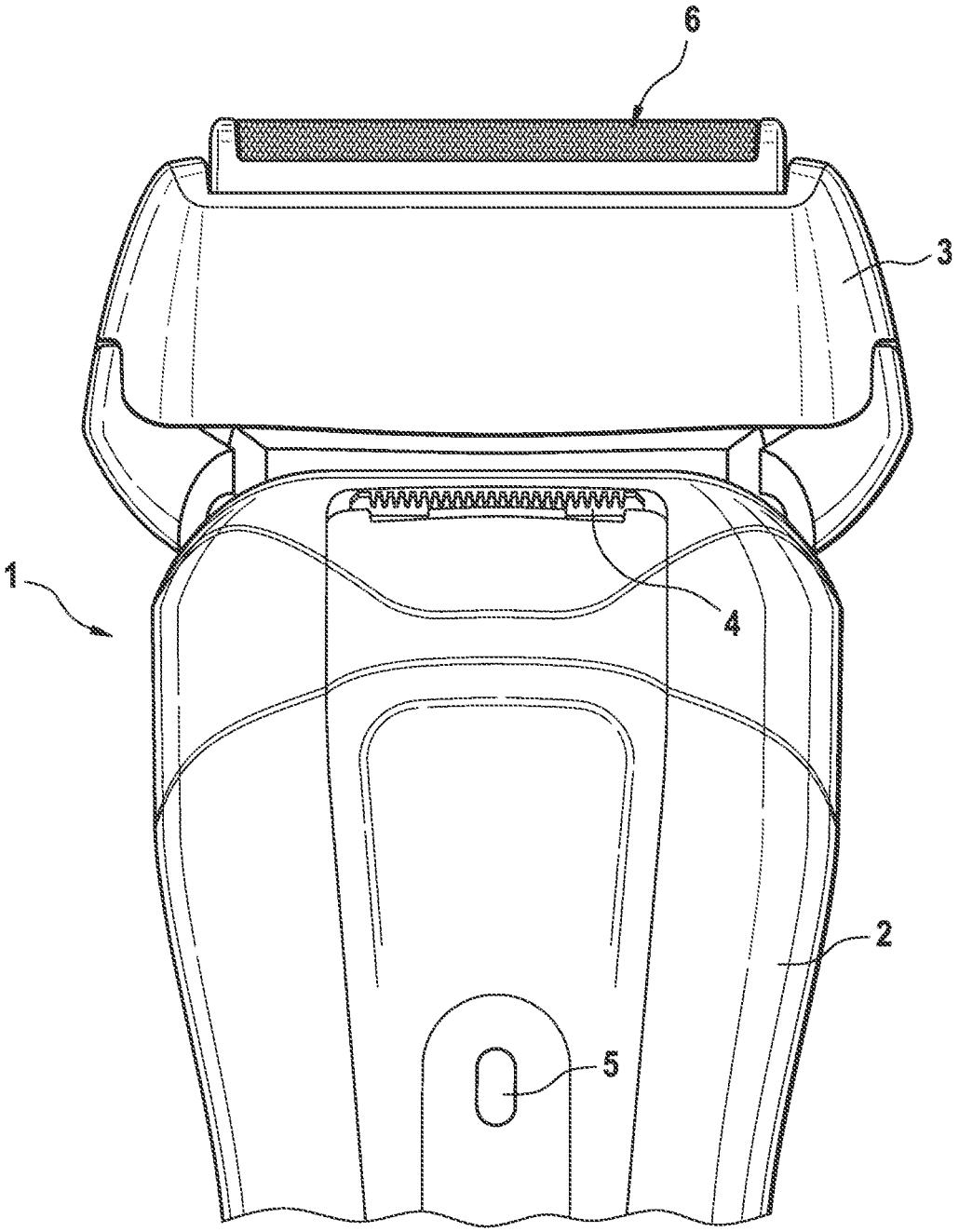
FIG. 1 is an illustration of an electric shaver.

FIG. 1 shows an illustration of an electric shaver in general. It essentially consists of a housing 2 carrying at its top a shaving head 3 and at the front part of the housing 2 a long-hair clipper 4. Inside the housing 2 there is arranged an electric motor for driving all the cutting parts when the shaver is switched on via the ON/OFF switch 5. The electric motor is not shown in the drawing.

Figure 2:
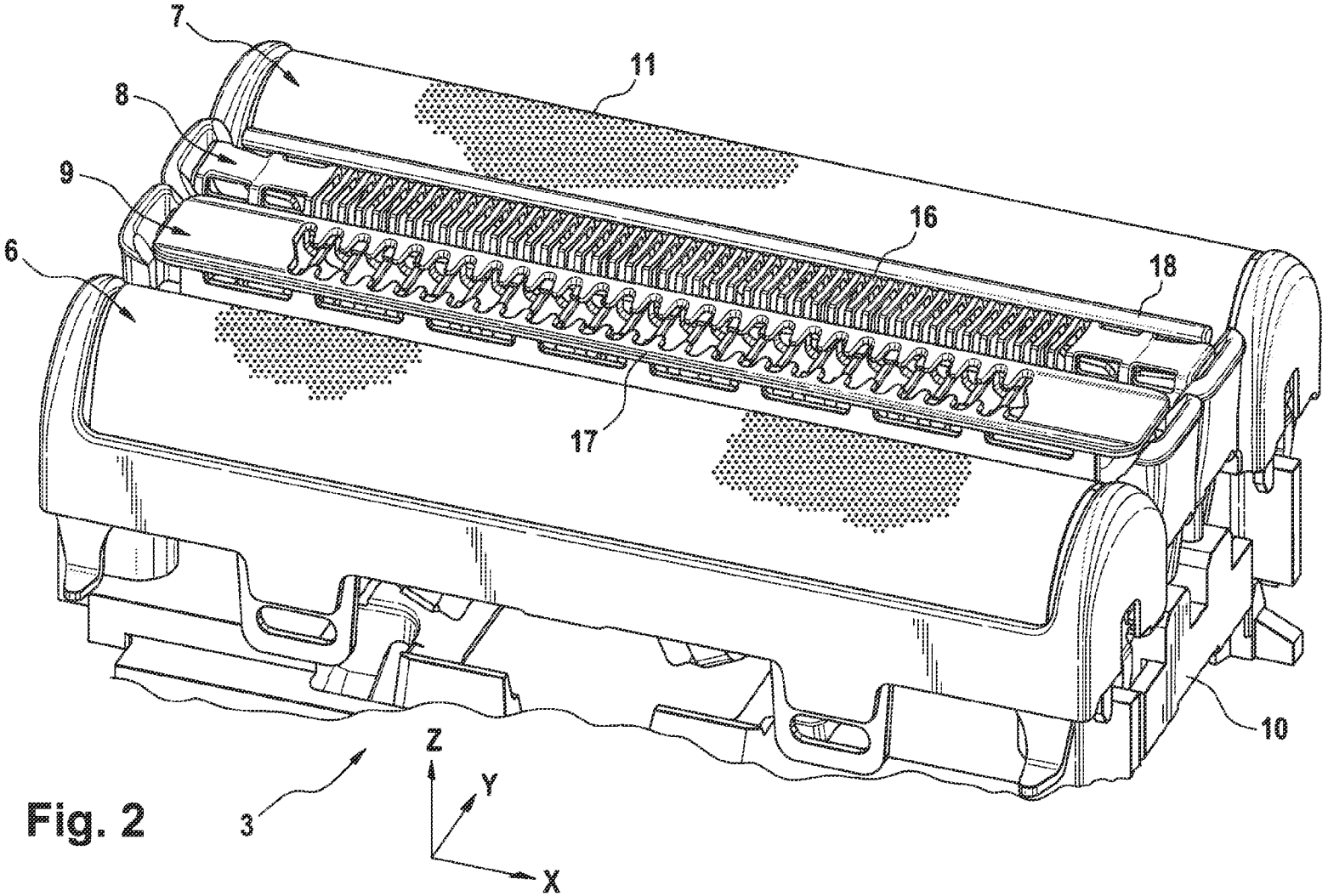
FIG. 2 is a perspective illustration of an exemplary embodiment of the invention.

FIG. 2 gives an enlarged perspective top view of the shaver head 3 depicting all the four cutting units which are the first foil-type cutting unit 6, the second foil-type cutting unit 7, the first trimmer-type cutting unit 8 and the second trimmer-type cutting unit 9. According to this embodiment the two foil-type cutting units 6, 7 are identical while the two trimmer-type cutting units 8, 9 differ from each other in their design. However, also the foil-type cutting units might be of different size, shape or may have different perforations. All the four cutting units are floatably mounted on a base element 10 and each cutter unit consists of an inner and an outer cutter which are—as known per se—arranged to be moved in sliding contact relative to each other and are driven by the electric motor and/or appropriate coupling elements, respectively. All the four cutting units are elongated along their longitudinal axis X over a length of about 45 mm and arranged in parallel along this axis X. The width of each trimmer-type cutting unit 8, 9 is about 5.5 mm and the width of each of the two foil-type cutting units 6, 7 is about 8 mm. The two trimmer-type cutting units 8, 9 are arranged in-between the two foil-type cutting units 6, 7. Both foil-type cutting units 6, 7 are composed of a shaving foil 11 acting as outer cutter and a cutting block 12 acting as inner cutter. The shaving foils 11 are hemi-spherically formed and are arranged the longitudinal axis X. They are perforated by the plurality of holes which in total build up a hole pattern in a way known per se. During a shave stroke the hairs are introduced into and through the holes of the shaving foil to be then cut by the cutting block 12 (see FIGS. 5 and 6) which is arranged underneath the shaving foil 11 and moved relatively to the shaving foil 11 in sliding contact. The cutting block 12 consists of a number of curved blades 13 mounted on a carrier 14, whereby this technique is per se known from the prior art cited above. The cutter block 12 is preloaded by a spring 15 which is supported by the base element 10 and biases the cutting block 12 permanently against the shaving foil 11.

Figure 3:
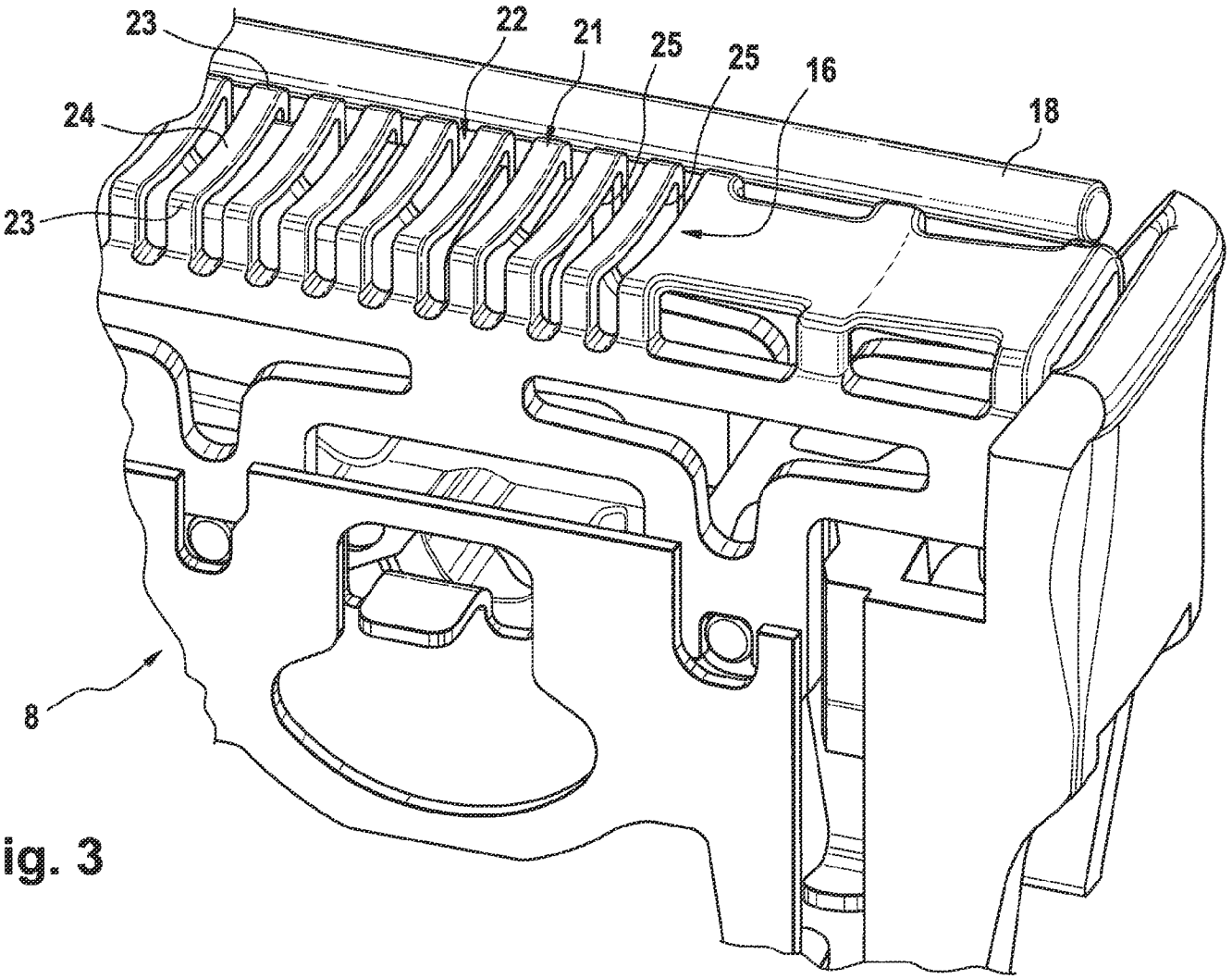
FIG. 3 is an enlarged illustration of the first trimmer-type cutting unit according to the invention.
Figure 4:
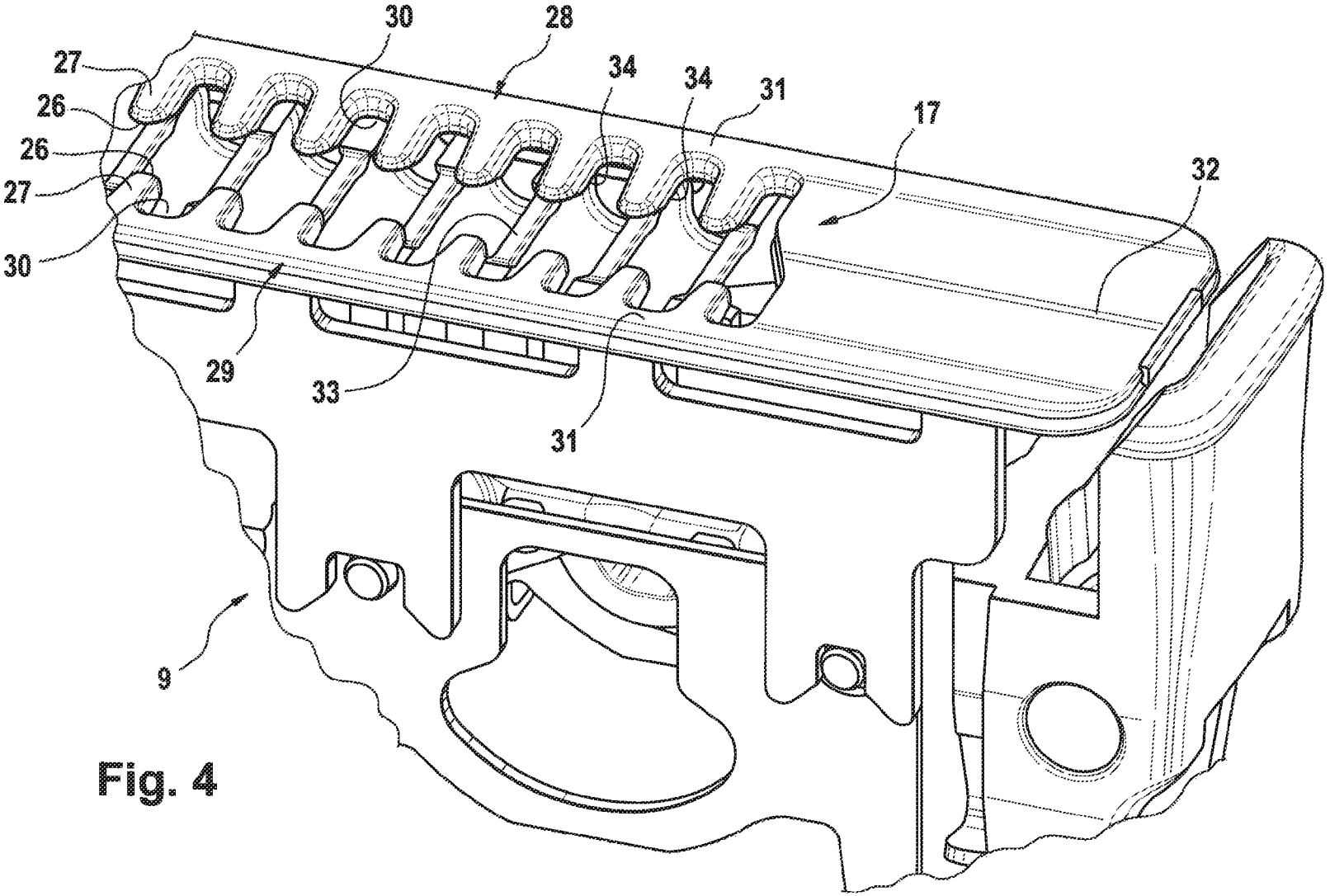
FIG. 4 is an enlarged illustration of the second trimmer-type cutting unit according to the invention.

As can be taken from the FIGS. 2 to 4, the two trimmer-type cutting units 8, 9 each comprise completely different outer cutters 16, 17. Additionally, the first trimmer-type cutting unit 8 is carrying a guard element 18 which is provided on its longitudinal side (X) which is next to the second foil-type cutting unit 7. The U-shaped inner cutters 19, 20 of the first and second trimmer-type cutting units 8 and 9 are very similar to each other and differ essentially only in the pitch of the cutting bars, whereby the pitch of the cutting bars of the first trimmer-type cutting unit 8 is much smaller than the pitch of the cutting bars of the second trimmer-type cutting unit 9.

Figure 5:
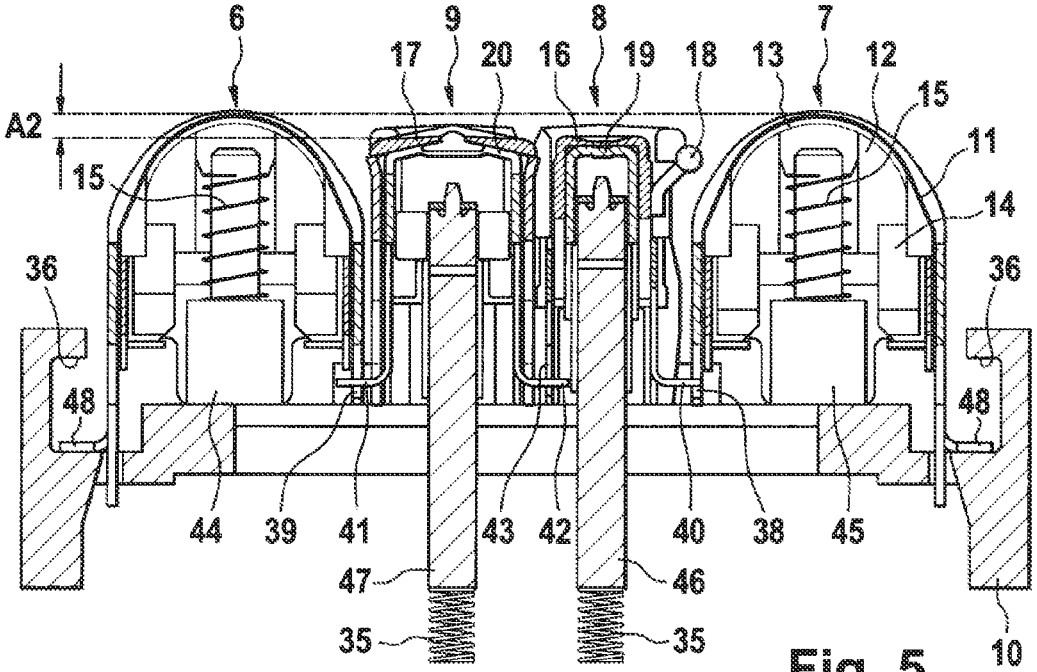
FIG. 5 is a schematic depiction of a cross-section through a shaver head according to the invention where the cutting units are depressed to the basis.
Figure 6:
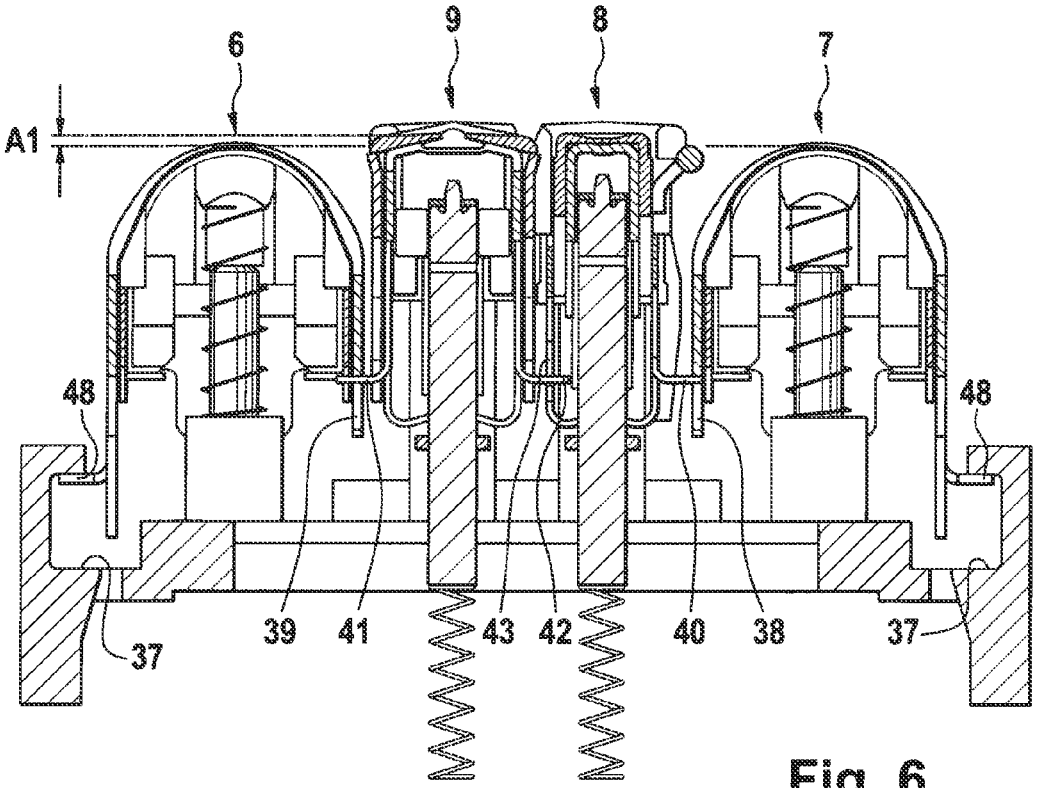
FIG. 6 shows a schematic cross-section through the shaving head where all cutting units are free of external load.

As can be taken best from FIG. 3, the outer cutter 16 of the first trimmer-type cutting unit 8 comprises a plurality of bars 21 regularly disposed by a certain distance to define slots 22 in-between two adjacent bars. The first trimmer-type cutting unit 8 is described in more detail in the WO2010/025902 A1. The bars 21 extend along the lateral axis Y which is perpendicular to the oscillating direction of the undercutters. The slots 22 extend entirely across the complete width of the outer cutter 16. The bars 21 are curved inwardly so that their outer borders 23 are provided at a higher level as their mid 24. This results in a concave top surface when looking at a cross-section parallel to the extension of the bars 21. As can be seen in FIGS. 5 and 6, the bars 21 comprise a higher thickness in the area of the outer borders 23 in comparison to their thickness in their mid 24. This results in an optimum between the capability of feeding hairs and a close cut of captured hair by simultaneously reducing the risk of skin irritations. In a manner known per se the bars 21 are providing at their lower surfaces sharp cutting edges 25 which cooperate with cutting edges arranged at the top surface of the bars of the undercutter 19.

A second trimmer-type cutting unit 9 as shown in FIG. 5 provides an outer cutter 17 which is composed of two comb-like cutting elements, wherein the tips 26 of the respective teeth 27 are facing each other with an offset along the longitudinal axis Z of the first row 28 of teeth 27 in relation to the second row 29 of teeth 27. The amount of this longitudinal shift is about half of the pitch of the teeth 27 which is identical for both comb-like cutting elements and defined by the distance between two adjacent tips 26 arranged in one row 28, 29. As a result of this longitudinal shift, a tip 26 of one row 28, 29 of teeth 27 is directly facing the slit 30 of the opposite comb-like cutting element. The teeth 27 of each row are interconnected along the outer border of the second trimmer-type cutting unit 9, each by a conjunction bar 31 which extends along the longitudinal axis X. The teeth 27 are arranged in a way that their tips 26 are at a lightly higher vertical level (vertical axis Z) than the conjunction bars 31. This feature is produced by bending the outer cutter 17 along the longitudinal symmetry axis 32 which gives the whole outer cutter 17 a roof-shaped contour with a surface that increases in vertical direction from both outer borders 23 to the longitudinal symmetry axis 32. The increased tips 26 of the teeth 27 promote the lifting of hairs lying flat to the skin by deforming the skin and applying a contact force to the skin. In comparison to the conjunction bars 31 the tips 26 are increased in an amount of around 0.25 mm, which gives the best compromise between optimal lifting of hairs and gentleness to the skin. The distance between opposite tips 26 is about 1 mm. The pitch of the row of teeth 27 is about 0.9 mm. The undercutter 20 of the second trimmer-type cutting unit 9 has a U-shaped profile and it encompasses bars 33 which are disposed in regular distances of about 1.5 mm. The bars 33 are providing cutting edges on their top surface which interact with the cutting edges 34 arranged on the lower surface of the teeth 27.

FIG. 5 shows a cross-section through a shaving head 3 along a Y-Z plane. It shows working conditions where all the four cutting units 6 to 9 are depressed to the maximum into the direction to the base element 10 by compressing the springs 15 of the two foil-type cutting units and the springs 35 of the two trimmer-type cutting units 8, 9. In this state the two trimmer-type cutting units 8, 9 are lowered by a small amount (A2 is about 1 mm) in relation to the foil-type cutting units 6, 7. This condition occurs when pressing the shaving head 3 strongly to the skin and the difference A2 ensures an optimal contact of the two foil-type cutting units 6, 7 to the skin and a maximum wrapping of the shaving foils 11 by the skin.

In FIG. 6 there is shown a condition of a shaving head 3 where all four cutting units 6 to 9 are at their maximum exposure which condition will happen when the shaver is applied to the skin with only minor pressure. Under these circumstances the two trimmer-type cutting units 8 and 9 are raised above the shaving foils 11 by a value A1 of up to about 2 mm. The exposed position of the two trimmer-type cutting 8, 9 ensures an optimal effectiveness with respect to optimal feeding and/or lifting of hairs which are lying flat to the skin.

Since the slots 22 of the outer cutter 16 are opened sidewardly at their outer borders 23, it can occur under certain conditions that skin can be captured by and penetrate into the slots 22 during a shaving stroke. To avoid this penetration which could lead to skin irritations, there is arranged a guard element 18 which extends along the longitudinal axis X and is formed like a rod with a round cross-section. It is arranged at the first trimmer-type cutting unit 8 at its side which is adjacent to the second foil-type cutting unit 7. Its function to protect the skin from being captured in the slots 22 is most important under operation conditions as depicted in FIG. 6 where the cutting unit 8 is protruding the cutting unit 7. Especially these working conditions bear the risk for skin to be captured in the slots 22 because of the fact that the free distance between the outer cutter 16 and the shaving foil 11 is at its maximum value, which might allow a skin wave to be pressed into that gap. However also under the other shaving conditions is the guard element 18 is beneficial for avoiding irritation of the skin. It is not necessary to have a guard element 18 at the opposite side of the cutting unit 8 because the protection function is delivered by the cutting unit 9 which provides a conjunction bar 31 that is located next to the outer cutter 16.

The base element 10 provides an upper stop 36 and a lower stop 37 to limit the floating travel of the foil-type cutting units 6 and 7. The upper and the lower stops 36 and 37 interact with flaps 48 provided at the outer sidewalls of the foil-type cutting units 6 and 7. The first trimmer-type cutting 8 provides a coupling tap 40 which protrudes into the slit 38 arranged at the inner sidewall of the first foil-type cutting unit 6. The horizontal slit 38 comprises an upper and a lower stop for the coupling tap 40. Due to this coupling, the difference of the horizontal level of the two cutting units 7 and 8 are limited to the amount defined by the distance between the two stops of the slit 38.

FIG. 6 is showing the maximum difference which is A1. As can be taken from FIG. 6, the coupling tap 40 is at the upper stop of the slit 38. In an analog manner the second trimmer-type cutting unit 9 is coupled with a limited range of travel with the first foil-type cutting unit 6 via a coupling tap 41 which protrudes into the slit 39. To limit the difference in horizontal level between the trimmer-type cutting units 8 and 9, there is provided a coupling tap 42 at the right sidewall of the second trimmer-type cutting unit 9 which protrudes into the slit 43 provided in the left sidewall of the first trimmer-type cutting unit 8. Also the slit 43 defines an upper and a lower stop for the respective coupling tap 42. Due to the coupling between the four cutting units 6 to 9 via the coupling taps 40 to 42, all the four cutting units are still floatable independently but the difference in the vertical level between single cutting units is limited. This is provided to ensure a maximum of skin friendliness and to additionally provide the best contact between the outer cutters of the four cutting units to the skin.

FIG. 5 also shows the drives pins 44 to 47 which are coupled in a manner known per se (not depicted in the drawing) to the electric motor to drive the undercutters of the four cutting units 6 to 9.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving head for an electric dry shaver, comprising a base element for carrying at least three cutter units each providing an outer cutter and inner cutter arranged to be moved in sliding contact relative to each other, whereby at least one cutter unit comprises a foil-type outer cutter, wherein the shaving head further comprises a first trimmer-type cutting unit having an outer cutter that comprises a plurality of slots defined by a plurality of adjacent bar elements featuring cutting edges, and a second trimmer-type cutting unit having an outer cutter that comprises a plurality of teeth featuring cutting edges and spaced from each other to define a plurality of slits.

2. The shaving head as claimed in claim 1, wherein there is provided a further cutting unit of the foil type and that the two trimmer-type cutting units are arranged between the two foil-type cutting units.

3. The shaving head of claim 1, wherein the cutting units are mounted on the base element in a floatable manner in the vertical direction (Z).

4. The shaving head of claim 3, wherein the cutting units are interconnected with vertical play via coupling elements.

5. The shaving head of claim 1, wherein a skin protecting guard element is arranged between the first trimmer-type cutting unit and the adjacent foil-type cutting unit.

6. The shaving head of claim 5, wherein the guard element is fixed to the first trimmer-type cutting unit.

7. The shaving head of claim 1, wherein the outer cutter of the foil-type cutting unit comprises a longitudinal axis (X), is shaped essentially semi-cylindrically along the longitudinal axis (X) and at least one of the trimmer-type cutting units comprises a top surface which is not planar.

8. The shaving head of claim 7, wherein the first trimmer-type cutting unit provides a concave top surface and the second trimmer-type cutting unit has a convex or a roof-shaped surface.

9. The shaving head of claim 1, wherein the outer cutter of the second trimmer-type cutting unit comprises two comb elements disposed opposite one another, whereby the teeth of the first comb element are facing the teeth of the second comb element.

10. The shaving head of claim 9, wherein the teeth of the comb elements extend along a lateral axis (Y) and are angled with respect to a horizontal plane (X-Y) such that their tips are elevated.

* * * * *